United States Patent [19]

Mullen

[11] 4,287,696

[45] Sep. 8, 1981

[54] EXPANSIBLE CAULKING MATERIAL

[76] Inventor: William T. Mullen, 65 W. Street Rd., Suite A-220, Warminster, Pa. 18974

[21] Appl. No.: 56,343

[22] Filed: Jul. 10, 1979

[51] Int. Cl.[3] ..... E04B 1/62; E04F 15/14

[52] U.S. Cl. ..... 52/309.7; 52/396; 52/403; 404/47; 404/64

[58] Field of Search ..... 404/64, 47, 65; 52/309.4, 309.5, 309.6, 309.7, 396, 403

[56] References Cited

U.S. PATENT DOCUMENTS

| | | | |
|---|---|---|---|
| 1,960,374 | 5/1934 | Edmonds | 404/64 |
| 2,378,801 | 6/1945 | Sidell | 52/DIG. 7 |
| 2,393,100 | 1/1946 | Gallay | 52/DIG. 7 |
| 2,401,936 | 6/1946 | Jenkins | 404/64 |
| 2,951,006 | 8/1960 | Rubenstein | 52/DIG. 7 |
| 2,964,424 | 12/1960 | Mast | 404/64 |
| 3,317,189 | 5/1967 | Rubenstein | 52/DIG. 7 |
| 3,334,557 | 8/1967 | Fitzgibbon | 404/64 |
| 3,406,087 | 10/1968 | Potter | 404/64 |
| 3,446,340 | 5/1969 | Mullen | 52/403 |
| 3,713,263 | 1/1973 | Mullen | 52/403 |

FOREIGN PATENT DOCUMENTS

| | | | |
|---|---|---|---|
| 1091086 | 11/1967 | United Kingdom | 404/67 |

*Primary Examiner*—James A. Leppink
*Assistant Examiner*—Henry E. Raduazo
*Attorney, Agent, or Firm*—Z. T. Wobensmith, 2nd; Z. T. Wobensmith, III

[57] ABSTRACT

An expansible caulking material in strip form is disclosed suitable for use in sealing joints between vertical panels, and packing wide expansion joints occurring in decks of parking garages, bridges, airport runways and the like, with a shortened expansion time particularly for use in cold locations where the expansibility by reason of the adhesive impregnant would be unduly delayed. The caulking material comprises compressed and expansible strips of open cell plastic foam with one or more wires or strips therewith with the foam normally retained in compressed condition until ready for use, and in which an electric current is applied to the ends of the wires or strips to supply heat to speed up the expansion.

5 Claims, 10 Drawing Figures

EXPANSIBLE CAULKING MATERIAL

BACKGROUND OF THE INVENTION

1. Field of the Invention

This invention relates to expansible caulking material in strip form.

2. Description of the Prior Art

It has heretofore been proposed as shown in the U.S. Pat. to Mast, No. 2,964,424 to impregnate a foam packing material with asphalt, compress the packing material, insert it into a joint and permit it to expand to seal the joint.

In my prior U.S. Pat. No. 3,446,340, a compressible and reexpansible caulking strip is provided having an outer finished surface portion to protect the expansible portion.

A somewhat similar construction is shown in my prior U.S. Pat. No. 3,713,263 to serve as an expansion joint for roofs.

These caulking strips have proven suitable for many uses but in locations where low temperatures prevail the slow expansion because of the temperature has proven detrimental. The caulking strip of the present invention overcomes the difficulties encountered at low temperatures.

SUMMARY OF THE INVENTION

In accordance with the invention an expansible caulking material in strip form is disclosed suitable for use in sealing vertical joints between panels as well as in sealing wide horizontal expansion joints occurring in decks, parking garages, airport runways and the like, the caulking material being prepared and retained in compressed form for expansion at the time of use and in which provisions are made for internally heating the caulking material which is impregnated with an adhesive impregnant for adherence to the side walls of the spaces at the joints and for waterproofing the plastic foam used for the strips.

It is the principal object of the invention to provide an improved caulking strip of open cell plastic foam with an adhesive impregnant in compressed condition and retained in compressed condition for use and in which provisions are made for applying heat to shorten the time required for expansion.

It is a further object of the invention to provide a caulking strip of the character aforesaid which can be made in desired widths and which will be self-sealing upon expansion.

It is a further object of the invention to provide a caulking strip of the character aforesaid which can expand or contract with changing temperatures while still maintaining an effective seal.

It is a further object of the invention to provide a caulking strip that is simple to use, can be inexpensively made and which can be safely stored and shipped ready for use.

It is a further object of the invention to provide a caulking strip of the character aforesaid having built in provisions for interiorly applying heat to shorten the time required for expansion into sealing engagement.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

Description of the Preferred Embodiments

Figure 1:
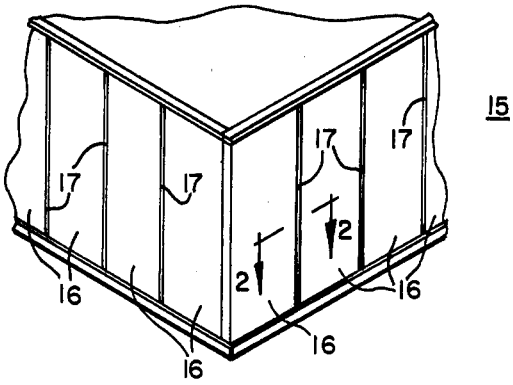
FIG. 1 is a perspective view of a portion of a building of vertical panel construction incorporating the caulking strip of the present invention.

Referring now more particularly to the drawings in which preferred embodiments of the invention are illustrated FIG. 1 shows a portion of a building 15 having a plurality of vertical panels 16 of cast stone or other cementatious material or of precast masonry structures. The panels 16 have vertical gaps or spaces 17 therebetween to be caulked.

Figure 2:
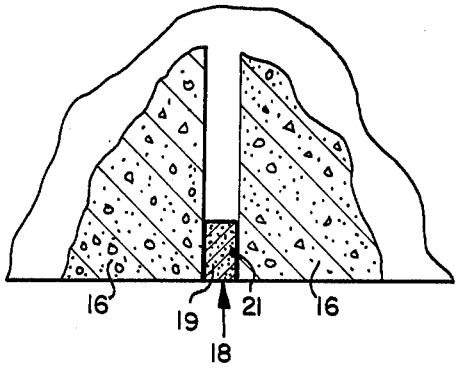
FIG. 2 is a vertical sectional view, enlarged, taken approximately on the line 2—2 of FIG. 1.
Figure 3:
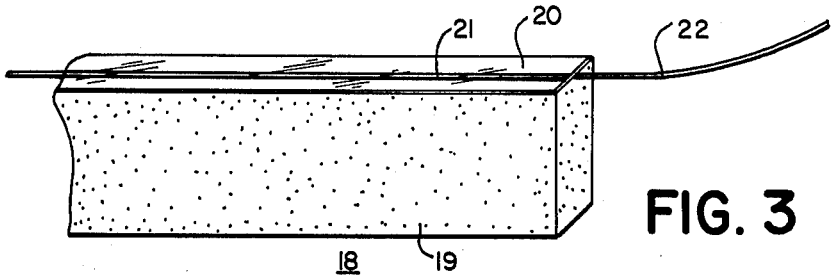
FIG. 3 is a fragmentary perspective view of a caulking strip in accordance with the invention.

The caulking strip 18 as illustrated in FIGS. 2 and 3 consists of a band 19 which is initially highly compressed open cell polyurethane plastic or similar cellular material and which has along one edge a release strip 20, preferably of polyethylene. The band 19, in FIG. 3 is shown in expanded condition. The band 19, in expanded condition, is preferably impregnated with an adhesive waterproof and water repellent material, asphalt being a suitable material as are other materials including butyls, acrylics, resins and waxes. For purposes of providing a waterproof seal, the compression is preferably to about 25% of the original dimension but must be able to fit within the spaces 17 to be sealed.

Before application of the release strip 20, a conductive metallic wire 21 is applied to the same edge, the wire 21 (see FIG. 3) having exposed ends 22 for connection of a source of electrical energy as hereinafter pointed out.

The caulking strips 18 in compressed form can be packaged in any desired manner, such as by being mechanically restrained but is preferably enclosed and sealed within a bag or envelop 25 of suitable synthetic plastic such as polyethylene, and under vacuum to prevent expansion.

Figure 4:
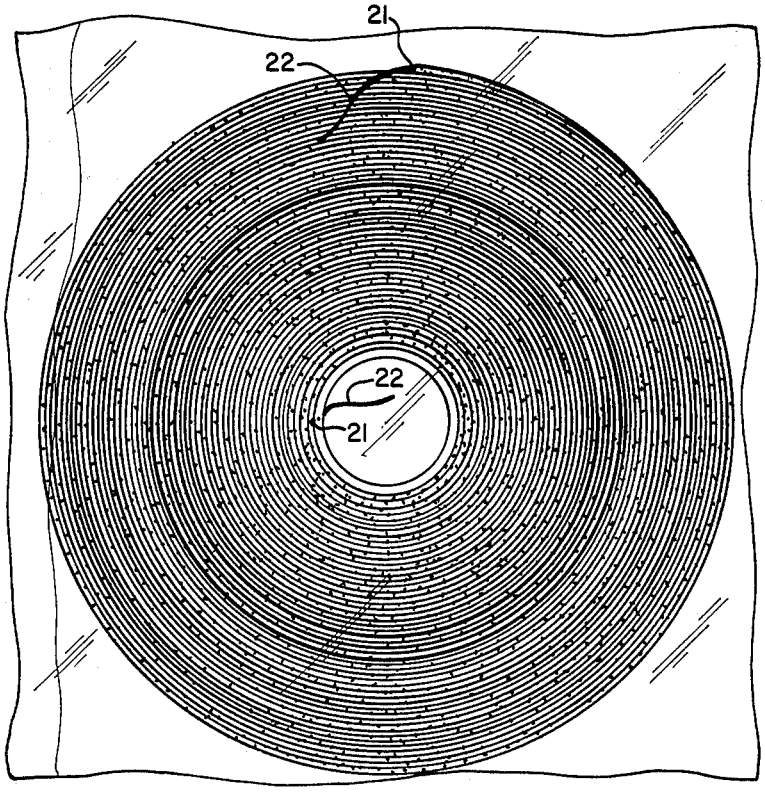
FIG. 4 is a view showing one mode of packing a length of caulking strip in accordance with the invention.

As shown in FIG. 4 the caulking strip 15 in compressed condition can be rolled on a core 26 with the respective turns separated by the release strip 20 and retained in the bag or envelop 25.

Figure 5:
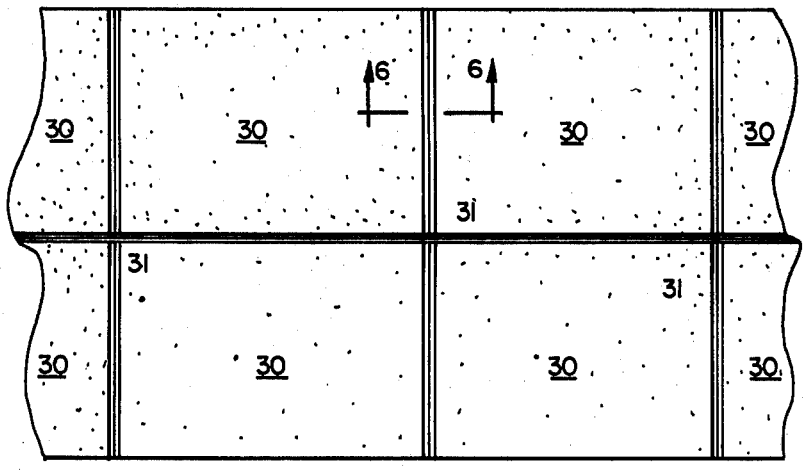
FIG. 5 is a top plan view of horizontal panels with the expansible caulking material of the present invention applied in cracks or spaces therebetween.

Referring now to FIG. 5 a plurality of panels 30 are shown in plan separated by joints 31. The panels 30 can be decks of parking garages or bridges, or portions of airport runways or the like. The joints 31 to be filled are frequently of different widths.

The caulking strips of this embodiment shown generally at 35 and as illustrated in FIGS. 6 to 9, inclusive, preferably consist of a plurality of bands 36 and 37 each of soft highly compressed open cell polyurethane plastic or similar cellular material secured together in any desired manner, such as by a compatible adhesive, such as asphalt. The bands 36 and 37, in fully expanded condition as before are preferably impregnated with an adhesive water proofing and water repellent material, asphalt being a suitable material. For purposes of providing a water proof seal the compression is preferably of the order of 25% of the original dimension.

Figure 6:
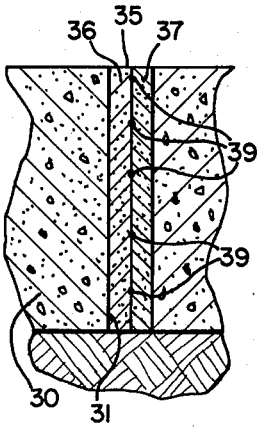
FIG. 6 is a transverse sectional view, enlarged, taken approximately on the line 6—6 of FIG. 5.
Figure 8:
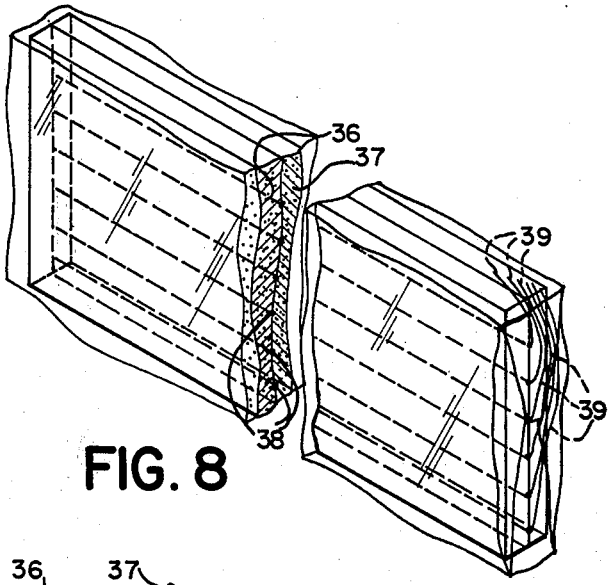
FIG. 8 is a view showing another mode of packing a length of caulking strip in accordance with the invention.
Figure 7:
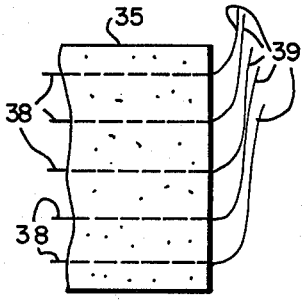
FIG. 7 is a fragmentary view at one end of the caulking strip of FIG. 6 showing the ends of the wires for heating.

In accordance with this embodiment of the invention which is better adapted for wider cracks or spaces between panels than those which commonly occur in vertical panels the bands 36 and 37, prior to being secured together are provided with a plurality of spaced metallic conductive wires 38, as shown in FIGS. 6 and 7, which have ends 39 extending beyond the ends of the bands 36 and 37 for connection to a source of electrical energy.

Figure 9:
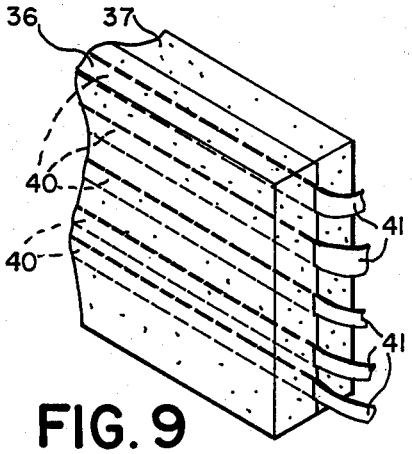
FIG. 9 is a view in perspective showing an alternative construction for applying heat internally.
Figure 10:
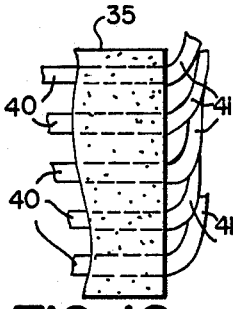
FIG. 10 is a fragmentary view at one end of the caulking strip of FIG. 9 showing the ends of the ribbons for heating.

As shown in FIGS. 9 and 10, in place of the wires 18, a plurality of spaced metallic conductive strips or ribbons 40 are shown, with ends 41 extending beyond the ends of the bands 36 and 37 for connection at their ends 41 to a source of electrical energy.

The bands 36 and 37 with the wires 38 or ribbons 40 inserted therebetween are secured together by a suitable adhesive, such as asphalt, and are then compressed to the desired extent determined by the nature of use desired. Advantageously for watertight sealing the compression is to about 25% of the initial dimension.

The finished side face to side face dimension must be such as to permit of insertion of the compressed caulking strip 35 into the joint to be sealed and with expansion to retain it within the desired and permitted expansion.

After the strip 35 has been compressed it can be retained in compressed condition in any desired manner such as by longitudinal clamping. It is preferred however that the strip 35 be sealed under vacuum in a coil with a release strip as in FIG. 4, or within a longitudinal airtight cover 42 of synthetic plastic, such as polyethylene, which can be readily separated from the caulking strip 35.

When the caulking strip 18 or 35 is to be employed in a joint 17 or 31 the cover 25 or 40 is removed and the strip 18 or 35 of the length available and prior to expansion, is inserted into the joint to be sealed. Electrical conductors, connected to a suitable source of electrical energy such as six or twelve volt battery are engaged with the wire ends 22, the wire ends 39 or the ribbon ends 41 to heat the wires 21 or 38 or the ribbons 40 to provide heat to accelerate the reexpansion of the strip 18 or 35 to engage the vertical side faces of the joints 17 or 31 for waterproof sealing. When this has been accomplished the conductors are disconnected and another strip 18 or 35 is inserted in sequence and heated.

The caulking strips are herein described have a wider range of use than those heretofore available, particularly in cold climates and for winter use.

I claim:

1. A caulking strip for insertion into a space or gap between panels for sealing which comprises a precompressed compressible and expansible sealing strip of open cell plastic material impregnated with a waterproof adhesive the viscosity of which varies with the temperature and having a volume of the order of one fourth of its expanded volume, said strip comprising a plurality of bands disposed in parallel relation and in adherent engagement, metallic heating means extending longitudinally of said strip between said bands with ends for connection thereto of a source of electrical energy, said heating means being electrically insulated by the plastic material and the impregnant, said strip being rapidly and continuously expansible by heat into gripping and holding relation in the joint between said panels and in expanded condition sealing said joint.

2. A caulking strip as defined in claim 1 in which said metallic heating means has end portions extending therefrom for connection to said source of electric energy.

3. A caulking strip as defined in claim 1 in which said metallic heating means are wires.

4. A caulking strip as defined in claim 1 in which said metallic heating means are metallic ribbons.

5. A caulking strip as defined in claim 1 in which said adhesive is asphalt.

* * * * *